US005993729A

United States Patent [19]

Lefebvre et al.

[11] Patent Number: 5,993,729

[45] Date of Patent: Nov. 30, 1999

[54] TREATMENT OF IRON POWDER COMPACTS, ESPECIALLY FOR MAGNETIC APPLICATIONS

[75] Inventors: Louis-Philippe Lefebvre, Montréal; Sylvain Pelletier, Ste-Julie; Claude Gélinas, Tracy, all of Canada

[73] Assignee: National Research Council of Canada, Ottawa, Canada

[21] Appl. No.: 08/796,564

[22] Filed: Feb. 6, 1997

[51] Int. Cl.[6] ..... B22F 3/02

[52] U.S. Cl. ..... 419/2; 419/19; 419/35; 419/44

[58] Field of Search ..... 419/2, 35, 45, 419/27, 19, 57, 44

[56] References Cited

U.S. PATENT DOCUMENTS

| | | | |
|---|---|---|---|
| 1,297,127 | 3/1919 | Elmen | 419/2 |
| 2,042,635 | 6/1936 | Schellens | 75/135 |
| 2,187,086 | 1/1940 | Koehring | 29/149.5 |
| 2,187,589 | 1/1940 | Lenel | 75/22 |
| 2,327,805 | 8/1943 | Koehring | 75/22 |
| 2,464,437 | 3/1949 | Dasher | 29/191.2 |
| 2,679,683 | 6/1954 | Luther, Jr. | 29/182.2 |
| 2,942,334 | 6/1960 | Blue | 29/182 |
| 3,366,479 | 1/1968 | Storchheim et al. | 75/214 |
| 3,615,381 | 10/1971 | Hammond | 75/213 |
| 3,997,341 | 12/1976 | Janowski et al. | 75/211 |
| 4,202,690 | 5/1980 | Funke | 75/224 |
| 4,314,849 | 2/1982 | Ro et al. | 75/228 |
| 5,462,903 | 10/1995 | Rousset et al. | 501/127 |
| 5,824,922 | 10/1998 | Aonuma et al. | 75/236 |

*Primary Examiner*—Daniel J. Jenkins
*Attorney, Agent, or Firm*—Juliusz Szereszewski

[57] ABSTRACT

Post-compaction treatments of iron compacts to improve the mechanical strength of the compacts are provided. Powder is compacted into the desired part. The part is then subjected to a strengthening operation. This operation involves a heat treatment at a moderate temperature combined with an optional resin impregnation. The heat treatment is done at a temperature sufficient to increase the mechanical properties of the compact while maintaining the magnetic losses low for the required application. Impregnation with an insulating binder can be effected to increase the mechanical strength of the part without creating electric contacts between the powder particles.

19 Claims, No Drawings

TREATMENT OF IRON POWDER COMPACTS, ESPECIALLY FOR MAGNETIC APPLICATIONS

FIELD OF THE INVENTION

This invention relates to a method of treatment of compacts, or compacted elements, made of iron powder or ferrous powder, and more specifically, to a method of improving at least the mechanical properties of such compacts particularly for magnetic applications. The invention also relates to the compacts produced by the method.

BACKGROUND OF THE INVENTION

Steel laminations have been used for decades in low frequency magnetic components, i.e. components which are subject to magnetic flux. The design of stacked magnetic components must take into account that the magnetic flux is confined in planes parallel to the sheet surfaces. Additionally, there are difficulties with miniaturisation and waste materials with steel laminations which can be important for some type of electric motors.

Since the beginning of the century, iron powder has been used for the production of magnetic components. Powder metallurgy offers the possibility of controlling the spatial distribution of the magnetic flux and allows practically full utilisation of materials even for the manufacture of complicated shapes. Recent advances in powder metallurgy offer new opportunities in the design of electromagnetic components. Several authors have shown the advantages of using iron/resin composites especially for applications in the medium and high frequency ranges.

The required mechanical and magnetic properties of a material depend of the application. For low frequency applications (50–60 Hz typically), the magnetic induction and the permeability must be as high as possible and the core losses must be minimised. Permeability is strongly influenced by the effective length of distributed air-gaps in iron/resin composites. Previous works have shown that permeability decreases dramatically when the resin content increases in iron/resin composites. The resin content should therefore be minimised to keep the permeability high in these materials.

When a magnetic material is exposed to an alternating magnetic field, it dissipates energy. The power dissipated under an alternating field is defined as core loss. The core losses are mainly composed of hysteresis and eddy current losses. Hysteresis losses are due to the energy dissipated by the domain wall movement. The hysteresis losses are proportional to the frequency and are mainly influenced by the chemical composition and the structure of the material. Some currents (i.e., eddy currents) are induced when a magnetic material is exposed to an alternating magnetic field. These currents lead to an energy loss through Joule (resistance) heating. Eddy current losses are expected to vary with the square of the frequency, the square of the powder diameter and inversely with the resistivity. Thus the relative importance of the eddy current losses depends on the material and increases as the frequency increases. At 60 Hz, the losses are mainly constituted of hysteresis losses in iron/resin composites. In contrast, in the case of sintered iron components, eddy currents are the most important part of the losses at the same frequency.

Uncoated iron powders are currently used to make sintered parts for DC magnetic applications. Sintered parts have low resistivity and are generally not used in AC applications. For applications in alternating magnetic field, a minimal threshold resistivity is required. Unsintered iron powder (green compact) has good magnetic properties, acceptable resistivity and can be used for low frequency magnetic applications. However, green compacts have low mechanical properties which will keep these materials off many applications. In AC applications, coated powders or powder mixes containing insulating resins are generally used. The dielectric is used to insulate and bind the magnetic particles together. Ward et al., U.S. Pat. No. 5,211,896 presented a review of the techniques to electrically insulate particles with coatings. A wide range of organic and inorganic insulating binders has already been used. Double coatings have also been used (Roseby, U.S. Pat. No. 1,789,477; Katz, U.S. Pat. No. 2,783,208; Rutz, U.S. Pat. No. 5,063,011; Soileau, U.S. Pat. No. 4,601,765) for applications in alternating magnetic fields.

T. Werber (Joining of Metallic Grains by Thermal Oxidation, J. Novotny and W. Weppner eds., Non-stoichiometric Compounds Surfaces, Grain Boundaries and Structural Defects, 547–556, 1989) studied the mechanism of formation of intergranular oxide joints in uncompacted iron powder in air at 400–800° C. Oxide layers of identical chemical compositions (e.g. $Fe_2O_3$) exist on both sides of the contact interface. The external (last formed) lattice planes are only partly ordered and the contact on the interface between growing oxide surfaces is very close. This generates an ordering process at the interface and the formation of a grain boundary between crystallites consisting of the same oxide. Therefore, the interparticle joint is a cohesive bond created by grain boundary formation. The oxide located between the remainders of both initial metal particles can be treated as a monolithic layer common to both particles.

Y. P. Orekhov et al. (Some Properties of a Soft Magnetic Material from Oxidised Iron Powder, Soviet Powder Metallurgy and Metal Ceramics, 15, No. 9 (September 1976), 706–710), studied the effect of the sintering temperature and atmosphere on the magnetic and electric properties of soft magnetic materials fabricated from oxidised iron powder. They showed that the electrical resistivity decreases as the sintering temperature varies from 350° C. to 750° C. (sintering time 0.5 h, steam atmosphere). They associate the variation of the electrical resistivity to changes in the composition and properties of the oxide. Using x-ray diffraction, the authors identified the oxide present at the surface of the powder as magnetite. As the sintering temperature increases, the diffusion of iron and oxygen ions increases in the oxide. The diffusion of oxygen ions in magnetite is slow compared to the diffusion of iron and the concentration of the $Fe^{2+}$ rises as the temperature increases. The presence of $Fe^{2+}$ facilitates the ionic exchange in the oxide layer between the oxide layer between the iron powder and then reduces the electrical resistivity of the material. These explanations do not take into account possible growing oxide thickness during the sintering.

The oxide naturally present at the surface of the iron powder insulates the particles and the oxide formed during the thermal oxidation treatment binds the particles together. If the sintering temperature is low, the sintering time is short and the atmosphere is appropriate, the insulative oxide layer between iron particles will be continuous and effective to provide parts with improved electrical resistivity compared to sintered iron, and improved mechanical strength compared to untreated iron powder compacts. This is important in soft magnetic material fabricated by P/M (powder metallurgy), intended for AC applications.

It is well known that dielectromagnetics containing iron and resins (thermosets or thermoplastics) such as those described above have very low eddy current losses and perform well in alternating magnetic fields. However, at low frequencies, e.g., 60 Hz, the amount of insulating material must be kept as low as possible in order to improve the ease of magnetisation. It is also known, as it is the case for most of the metal powders, that iron powder is naturally covered by a thin oxide layer which increases significantly the resistivity of bulk iron. For instance, the resistivity of green iron compacts is usually more than two orders of magnitude higher than for cast iron. However, it has not been expected that iron powder compacts can be used at low frequencies without any insulating material. It has been believed that eddy current losses are too high and that the mechanical strength is too low.

It is an object of the invention to develop a method of treatment of iron compacts to obtain the necessary magnetic and mechanical properties of the compacts for magnetic applications at low frequencies.

It is another object of the invention to provide a method to produce powder parts, or elements, with properties offering a compromise between the properties of sintered parts (high permeability) and dielectromagnetics composed of iron powder and resin (low eddy current losses).

It is also an object of the invention to provide powder compacts having the above-described advantageous properties.

Where iron powder is referred to, it is understood that another suitable ferrous alloy may be substituted for pure iron. It is also recognized that entirely pure, non-oxidized iron is practically non-feasible in an industrial environment.

SUMMARY OF THE INVENTION

It has been found that a post-compaction treatment can be effected on a ferrous powder (iron or iron-based compound or alloy powder) compact to improve at least the mechanical strength of the compact, with a view to making the resulting part particularly suitable for AC magnetic applications.

According to the invention, there is provided a method of treatment of iron-based powder, the method comprising:

providing a compacted powder element composed of binder-free particles of iron or iron-based compound or alloy, the degree of compaction being preferably such as to obtain elements with a desired level of magnetic permeability which corresponds typically, but not exclusively, to elements with TRS (transverse rupture strength) from about 3000 to about 7000 psi, and heating said compacted element in an oxygen-containing atmosphere to a temperature below sintering temperature, for a time sufficient to bind the particles together and to increase the mechanical strength of the compacted element.

In an embodiment of the invention, the heating is effected such as to develop thermal oxidation bonds between adjacent particles of the powder element.

The oxygen-containing atmosphere may be a water vapour atmosphere.

The element may be impregnated with a binder following the compaction but before the heating step. Alternatively, the element may be impregnated with a binder following the heating step, the impregnation being followed by a binder curing step, if necessary.

Impregnation is understood herein as a process in which inter-particular pores are filled with a binder without changing the size of the pores or, in other words, the distance between the cores of the particles.

The iron or iron-based particles are free of an organic binder before compaction, but they may have a layer of oxide thereon.

It is an advantage of the invention that a method is provided of processing uncoated and unblended iron powder into parts with high permeability, low losses and acceptable mechanical strength. The process allows to obtain a compromise between the properties of sintered parts (high permeability) and real dielectromagnetics composed of iron and resin (low eddy current losses).

It is a feature of this invention that no binder is added to the magnetic powder (e.g. by coating, blending or mixing) prior to the shaping and compaction of the part. Furthermore, the iron compacts can be resin-infiltrated to increase the mechanical strength.

It is also a feature of the invention that the powder compacts are not bound by sintering but rather by thermal oxidation bonding wherein an iron oxide interface is formed due to forced oxidation of the powder and binds the particles together thus affording added mechanical strength of the resulting element or part.

DETAILED DESCRIPTION OF THE INVENTION

A more detailed description and a best mode of carrying out the invention is given below.

As will be demonstrated below, it is possible to attain an improvement of both mechanical properties and some magnetic properties of the powder compacts using the method of the invention. However, the improvement of the mechanical strength is the primary objective of the work.

The powder suitable for the purpose of the invention is a ferromagnetic powder such as iron, oxidized iron or an iron alloy powder. For the purpose of the invention, all these terms can be used interchangeably.

Optionally, the powder may be chemically or electrochemically treated or coated before the compaction to electrically insulate the powder. This coating is not a binder For example the powder may be superficially oxidized so that the metallic core still has the ferromagnetic properties. Alternatively, the electroinsulating layer can be applied by a sol-gel process (a variety of oxides) or by phosphatation. The typical average particle size of the starting powder can range from 5 $\mu$m to 1 mm, preferably below 590 $\mu$m or 30 US mesh, but preferably below than 250 $\mu$m or 60 US mesh.

In the tests to validate the invention, the powder used was ATOME™ 1001HP water-atomised iron powder designed for soft magnetic P/M applications available from Quebec Metal Powders Limited, Tracy, Quebec, Canada. This iron powder is characterised by a particle size distribution smaller than 250 $\mu$m.

The powder was compacted or molded into the desired component or shape. Generally, the method used to consolidate metal powders into integral components involves putting the powder in a die and pressing the powder at the appropriate pressure and temperature. Molding the parts at higher pressure and temperature increases the density and consequently the permeability. However, increasing the compacting pressure and temperature reduces by the same way the electrical resistivity of the compacts and consequently increase eddy currents in the parts as frequency increases.

It is important to note that the heat treatment mentioned above is different from the treatment generally used to cross link or bind the resin in the fabrication of iron/resin composites since the starting powder used here does not contain a binder.

For the step of heating in an oxidizing atmosphere step, it is recommended not to exceed the temperature at which sintering could start, as the electrical conductivity of the powder compact is rising rapidly when the temperature of the heat treatment exceeds a certain level.

The atmosphere should be oxidizing enough to produce metal oxide bonds between the adjacent powder particles and accordingly, give rise to an increase of the mechanical strength of the compact. If the powder is uncoated, the treatment should be done at a temperature lower than 300° C., preferably between 150 and 250° C. If the powder is coated or oxidized, the treatment should be done at a higher temperature, substantially reversely related to the degree of oxidation or coating. The temperature should however be chosen such as to prevent extensive interparticular diffusion of iron. It should be noted that the thermal treatment is not sintering but a thermal oxidation bonding of the powder compact. For coated or oxidized powder, the temperature should typically be lower than 6000° C.

The molded (compacted) component can be impregnated with a binder before or after the thermal treatment in order to further increase the mechanical strength of the compact. The binder can be selected from the group consisting of thermosetting and thermoplastic resins, low melting point inorganic insulators or their precursors. The only limitation on the choice of the binder, which must be electroinsulative for magnetic use, is its ability to flow within the pores of the powder compact during the impregnation and increase the mechanical strength of the parts. The binder can be melted or dissolved in a compatible solvent prior to the impregnation. The infiltration can be done at room temperature or at an elevated temperature, under atmospheric pressure or under positive pressure optionally with heating to make the impregnation easier. The impregnation can be done for instance in an autoclave, also using ultrasonic energy or using chemical vapour infiltration. Depending on the type of binder used, a heat treatment can be done after the infiltration. If the impregnation is effected before the heating step, the thermal oxidation bonds may not develop, but the mechanical strength will increase as a result of the binding action.

A particularly interesting feature of the present invention is that the parts fabricated according to the methods described above have high density, high permeability compared to dielectromagnetics fabricated with the same powder, high strength compared to green compacts and low eddy current losses at 60 Hz compared to sintered iron.

EXAMPLE 1

To evaluate the effect of a heat treatment on the mechanical and magnetic properties of components fabricated by powder metallurgy, ATOMET™1001HP water-atomised iron powder specially designed for soft magnetic application was used. The powder was used in the as-delivered condition. There was no lubricant or additive in the powder and die wall lubrication with graphite spray was used for all compactions. Transverse rupture strength bars (3.175×1,270×0,635 cm) were compacted according to MPIF Standard 15. Rings (5.08 o.d.×4.45 i.d.×1.27 cm) were also compacted to evaluate the magnetic properties (permeability and core losses) of the materials. All the samples were compacted at 65° C. with a pressure of 45 tsi in a floating compaction die. The properties of the parts were determined before and after a heat treatment which was carried out for 1 hour at 175° C. in air. Density (measured from the weight and physical dimension of parts), electrical resistivity (measured with a micro-ohmmeter and a four-point contact probe) and transverse rupture strength (MPIF Standard 15) of the bars were determined. Magnetic characterisation of the samples (permeability and core losses) at low frequency (60 Hz) was done using a KJS SMT/ACT-500 computer-automated magnetic hysteresisgraph. Properties of these materials were compared with those of iron/0.8% resin composites processed in the same conditions and sintered iron compacts. The iron/0.8% resin composite is a commercial product ATOMET™ EM-1 available from Quebec Metal Powders Limited, Tracy, Quebec, Canada.

TABLE 1

Properties of iron compacts fabricated with regular and coarse (>45 μm) ATOMET ™1001HP powder before and after a heat treatment of 1h at 175° C. in air. The properties of sintered iron compacts and iron/0.8% resin composites are given for comparison.

| Materials | Density (g/cc) | Resistivity (μ½-m) | TRS (psi) | μ (G/Oe) | Losses (0.5T/60Hz) (W/lb) | Losses 1.0/T 60Hz) (W/lb) |
|---|---|---|---|---|---|---|
| 1001HP | 7.27 | 3.63 | 6951 | 681 | 1.61 | 5.13 |
| 1001HP heat-treated. | 7.28 | 1.10 | 10587 | 708 | 1.60 | 5.12 |
| 1001HP, >45μm | 7.27 | 3.99 | 6496 | 756 | 1.54 | 4.88 |
| 1001HP, >45μm heat-treated | 7.30 | 1.00 | 11036 | 741 | 1.59 | 5.09 |
| Sintered iron | 7.27 | ~0.15 | ~85000 | ~4000 | ~3.30 | ~25 |
| Iron/0.8% resin | 7.18 | 250 | 18480 | 458 | 1.60 | 4.98 |

Density was not strongly influenced by the heat treatment and the granulometry of the powder. Density of the iron powder (green or heat treated) was however significantly higher than density of iron/resin composites. Since density of iron compacts was higher than density of iron/resin composites, the permeability of the former is significantly higher than that of the latter. Resistivity of iron powder green compacts is around 25 times the resistivity of sintered iron compacts and is significantly lower than the resistivity of the iron/resin composites. However, losses in unsintered compacts and iron/resin composites are similar since the resistivity of these samples is sufficient to keep the eddy current losses low. The resistivity of iron sinters is not sufficient to keep the eddy current losses low and the losses in these materials are much higher than the losses in dielectromagnetics or iron powder compacts (green or after a heat treatment).

The heat treatment had a significant effect on the mechanical properties of the iron powder compacts. The transverse rupture strength of the compacts fabricated with the coarse powder (>45 μm) increased from 6,500 psi to 11,000 psi after the heat treatment. This increase is significant and was unexpected due to the low temperature of the heat treatment. The heat treated samples fabricated with the coarse powder have high permeability (741), low losses (1.59 W/lb at 0.5 T and 60 Hz) and good mechanical properties (11,000 psi).

EXAMPLE 2

To evaluate the effect of the infiltration on the mechanical properties of components fabricated by powder metallurgy, the same ATOMET™1001HP water-atomised iron powder already described in example 1 was used. The powder was used in the as-delivered condition. There was no lubricant or additive in the powder and die wall lubrication with graphite spray was used for all compactions. Transverse rupture strength bars (3.175×1.270×0.635 cm) were compacted according to MPIF Standard 15. All the samples were compacted at 65° C. with a pressure of 45 tsi in a floating compaction die. The properties of the parts were evaluated before and after the infiltration and heat treatment. Solutions composed of 30 g or 50 g of phenolic resin in 100 ml of acetone were used for the infiltration. The less concentrated solution was used for the infiltration at 20° C. and the most concentrated solution was used for infiltration at 65° C. The resin impregnation was done as follows: at room temperature and under atmospheric or partial pressure of 20" of Hg, and in an autoclave at 65° C. under a pressure of 200 psi. In all cases, a heat treatment (1h/175° C. in air) was done after the infiltration in order to cross link the resin and increase the bonding between the resin and the iron particles. Density (measured from weight and physical dimension of parts and transverse rupture strengths (MPIF Standard 15) were evaluated on the TRS bars after the infiltration and heat treatment. The properties of the materials were compared with iron/0.8% resin composites processed as-described in Example 1.

TABLE 2

Properties of iron compacts fabricated with ATOMET ™1001HP iron powder before and after resin infiltration in air. The properties of iron/0.8% resin composites are given for comparison.

| Materials | Temperature of infiltration (°C.) | Pressure of infiltration (psi) | Final Density (g/cc) | TRS (psi) |
|---|---|---|---|---|
| 1001HP | — | — | 7.27 | 6951 |
| 1001HP + H.T. | — | — | 7.27 | 10587 |
| 1001HP + H.T. | 20 | Atm.* | 7.26 | 13288 |
| 1001HP + H.T. | 20 | 20" Hg** | 7.26 | 13398 |
| 1001HP + H.T. | 65 | 200 | 7.26 | 15750 |
| Iron/0.8% resin | — | — | 7.18 | 18480 |

*atmospheric pressure
**under partial pressure

Table 2 shows that the final density was not strongly affected by the impregnation process. Density of the iron powder compacts (green or heat treated) is however significantly higher than density of iron/resin composites. This is due to the high density that can be reached by compacting pure iron powders and the fact that the low amount of resin used for the resin infiltration mainly goes into the pores and does not affect the density of the specimens.

Infiltrated iron compacts show higher mechanical strengths than non-infiltrated iron powder compacts as-pressed or after a heat treatment. The mechanical strength of iron/0.8% resin is higher but the infiltrated compacts show a higher (apparent) density and have a mechanical strength adequate for many applications. The mechanical strength of iron compacts increases from 6,951 to 15,750 psi after both the heat treatment at low temperature and resin-infiltration: this is an increase of approximately 125%. The resin-infiltration increases the mechanical strength of heat-treated iron compacts by 49% (15750 compare to 10587 psi). This increase is significant and was unexpected due to the low resin content and low heat treatment temperature used.

The starting material is inexpensive, the processes are simple (both heat-treatment and resin-impregnation) and allow to produce net shape parts with isotropic properties (magnetic and thermal) and an adequate mechanical strength f or many magnetic applications. Since parts are made with a low resin or binder content, parts with fairly high thermal conductivity can be produced.

It will be appreciated by those skilled in the art that the above results are exemplary only and that a certain amount of routine experimentation may be necessary to develop useful optimum conditions for a desired result. For example, the temperature and time of the heating step (typically inversely dependent), the choice of impregnating binder, if any, the degree of compaction etc. may all vary. Also, obvious equivalents are understood to come within the ambit and scope of the invention which is defined by the appended claims.

We claim:

1. A method of producing iron-based powder elements, the method comprising the steps of:

providing a compacted iron-based powder element composed of binder-free particles of iron or iron-based compound or alloy, and heating said compacted element in an oxygen-containing atmosphere to a temperature below sintering temperature for a time sufficient to bind said particles together and increase the mechanical strength of said compacted element.

2. The method according to claim 1 wherein said oxygen-containing atmosphere is a water vapour atmosphere.

3. The method of claim 1 wherein said powder is partly oxidized before said compacting step.

4. The method according to claim 3 wherein said heating step is conducted in a temperature below about 600° C., the temperature being inversely dependent on the degree of the oxidation of said powder.

5. The method of claim 1 wherein said particles are individually coated with an electroinsulating non-binding layer before compaction.

6. The method of claim 5 wherein said heating step is conducted in a temperature below about 600° C., the temperature being inversely dependent on the thickness of said layer.

7. The method of claim 1 wherein said heating step is conducted at a temperature in the range from about 150 to about 250° C. over a time period sufficient for a thermal oxidation bond to be developed between said particles of said powder.

8. The method of claim 1 wherein said heating step is followed by the step of introducing an electroinsulative binder into spaces between said particles of said powder element.

9. The method of claim 8 wherein said binder is an organic resin introduced by impregnation.

10. The method of claim 8 wherein said binder is cured after being introduced into said pores.

11. The method of claim 8 wherein said binder is a self-curing binder.

12. A compacted powder element obtained by the process of claim 1.

13. A method of producing iron-based powder elements, the method comprising the steps of:

providing a compacted powder element composed of binder-free particles of iron or iron-based compound or alloy, introducing an electroinsulative binder into pores between said particles of said compacted element, and heating said compacted element in an oxygen-containing atmosphere to a temperature below sintering temperature for a time sufficient to bind said particles together and increase the mechanical strength of said compacted element.

14. The method according to claim 13 wherein said binder is an organic resin introduced by impregnation.

15. The method according to claim 13 wherein said oxygen-containing atmosphere is a water vapour atmosphere.

16. The method of claim 13 wherein said powder is superficially oxidized before said compacting step.

17. The method according to claim 16 wherein said heating step is conducted in a temperature below about 600° C., the temperature being inversely dependent on the degree of the oxidation of said powder.

18. The method of claim 13 wherein said particles are individually coated with an electroinsulating layer before compaction.

19. The method of claim 18 wherein said heating step is conducted in a temperature below about 600° C., the temperature being inversely dependent on the thickness of said layer.

* * * * *